US008427263B2

(12) United States Patent
Hoppe et al.

(10) Patent No.: US 8,427,263 B2
(45) Date of Patent: Apr. 23, 2013

(54) PROPORTIONAL MAGNET FOR A HYDRAULIC DIRECTIONAL CONTROL VALVE AND METHOD FOR THE PRODUCTION THEREOF

(75) Inventors: Jens Hoppe, Erlangen (DE); Stefan Konias, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/146,707

(22) PCT Filed: Dec. 8, 2009

(86) PCT No.: PCT/EP2009/066602

§ 371 (c)(1),
(2), (4) Date: Jul. 28, 2011

(87) PCT Pub. No.: WO2010/086058

PCT Pub. Date: Aug. 5, 2010

(65) Prior Publication Data

US 2011/0285484 A1 Nov. 24, 2011

(30) Foreign Application Priority Data

Jan. 28, 2009 (DE) ..... 10 2009 006 355

(51) Int. Cl.
*H01F 7/08* (2006.01)
*H01F 3/00* (2006.01)

(52) U.S. Cl.
USPC ..... 335/262; 335/255; 335/261; 335/270; 335/273; 335/281

(58) Field of Classification Search ..... 335/220, 335/236, 253, 255, 258, 261, 262, 270, 273, 335/274, 278, 279, 281, 282, 296, 297, 299; 310/12, 15, 17, 23, 24
See application file for complete search history.

(56) References Cited

U.S. PATENT DOCUMENTS

| | | | | |
|---|---|---|---|---|
| 2,407,963 | A * | 9/1946 | Persons | 335/261 |
| 4,493,474 | A * | 1/1985 | Ohyama | 251/129.01 |
| 4,919,390 | A | 4/1990 | Ichiryu et al. | |
| 5,856,771 | A * | 1/1999 | Nippert | 335/262 |
| 6,615,780 | B1 * | 9/2003 | Lin et al. | 123/90.17 |

(Continued)

FOREIGN PATENT DOCUMENTS

| | | | |
|---|---|---|---|
| DE | 101 53 019 | A1 | 5/2003 |
| DE | 102 11 467 | A1 | 9/2003 |
| DE | 103 00 974 | A1 | 7/2004 |
| DE | 10 2004 057 873 | A1 | 6/2005 |
| DE | 10 2005 048 732 | A1 | 4/2007 |
| DE | 10 2006 015 233 | A1 | 10/2007 |
| GB | 2 257 566 | A | 1/1993 |
| JP | 2005 188630 | A | 7/2005 |

*Primary Examiner* — Mohamad Musleh
(74) *Attorney, Agent, or Firm* — Lucas & Mercanti, LLP

(57) ABSTRACT

A proportional magnet for a hydraulic directional control valve and a method for the production thereof. The proportional magnet has a coil unit, a bearing unit and a pole disk. The coil unit has a cylindrical coil, a cylindrical magnet casing surrounding the coil, an annular yoke disc arranged at a face of the magnet casing and a housing. The bearing unit has a yoke with a first bearing point, a pole core with a second bearing point, and an armature unit with a magnet armature and a pressure pin. The bearing points and armature unit are aligned coaxially by a centering sleeve. When mounting the proportional magnet, the bearing unit is inserted into a cylindrical opening of the coil unit and the pole disc is put on the coil unit after the bearing unit is inserted for axially fixating the bearing unit and closing the magnetic circuit.

11 Claims, 5 Drawing Sheets

U.S. PATENT DOCUMENTS

| | | | | |
|---|---|---|---|---|
| 6,918,571 | B1 * | 7/2005 | Rose | 251/129.18 |
| 7,209,020 | B2 * | 4/2007 | Telep | 335/255 |
| 2002/0104977 | A1 * | 8/2002 | Bircann et al. | 251/129.15 |
| 2004/0257185 | A1 * | 12/2004 | Telep | 335/220 |
| 2005/0024174 | A1 * | 2/2005 | Kolb et al. | 335/220 |
| 2005/0133099 | A1 * | 6/2005 | Ino et al. | 137/625.65 |
| 2005/0218363 | A1 * | 10/2005 | Furuta et al. | 251/129.15 |
| 2008/0180200 | A1 | 7/2008 | Gamble | |
| 2009/0039992 | A1 * | 2/2009 | Ryuen et al. | 335/255 |
| 2011/0285484 | A1 * | 11/2011 | Hoppe et al. | 335/229 |

* cited by examiner a)

b)

PROPORTIONAL MAGNET FOR A HYDRAULIC DIRECTIONAL CONTROL VALVE AND METHOD FOR THE PRODUCTION THEREOF

CROSS-REFERENCE TO RELATED APPLICATIONS

This application is a 371 of PCT/EP2009/066602 filed Dec. 8, 2009, which in turn claims the priority of DE 10 2009 006 355.2 filed Jan. 28, 2009. The priority of both applications is hereby claimed and both applications are incorporated by reference herein.

BACKGROUND OF THE INVENTION

The invention relates to a proportional magnet for a hydraulic directional control valve and to a method for the production thereof.

Directional control valves of this kind are used, for example, in internal combustion engines for the actuation of hydraulic camshaft adjusters.

DE 103 00 974 A1 discloses a proportional solenoid valve of a camshaft adjuster device for motor vehicles. The proportional solenoid valve has a valve housing in which a piston can slide and which has a plurality of connections via which hydraulic oil can be supplied. The proportional solenoid valve also comprises an electromagnet part with which the piston can be adjusted by means of a plunger. The plunger is mounted in an axial bore in a housing of the electromagnet part, as a result of which it can slide axially.

DE 102 11 467 A1 presents a camshaft adjuster having an electromagnet which is designed as a repelling proportional magnet. The proportional magnet has a magnet armature which is fixedly seated on an armature plunger which is guided through a pole core and which bears with a free end surface against a control piston or against a part fixedly connected thereto. The magnet housing and magnet flange are screw-connected to a control housing cover and sealed off by means of a flat sealing means.

DE 101 53 019 A1 describes an electromagnet which is suitable, in particular, as a proportional magnet for operating a hydraulic valve. The electromagnet comprises a hollow cylindrical coil former which is delimited by an upper pole shoe and a lower pole shoe. The electromagnet is surrounded by a magnet housing. The coil former acts magnetically on a magnet armature which transmits the magnetic force onward via a plunger rod for operating the hydraulic valve. The plunger rod is mounted in an axial bore in the lower pole shoe, as a result of which it can slide axially.

DE 10 2004 057 873 A1 relates to a seat valve having a line system for conducting an inflowing medium through it. The seat valve has a seat and an adjustable closing element in the line system. The adjustable closing element is operated by means of an electromagnetic actuating device. The electromagnetic actuating device comprises an armature housing in which an armature is arranged so as to be adjustable in the direction of a coil axis. The armature is connected to an actuating element which operates the closing element. The actuating element is mounted in an axial bore in the housing of the electromagnetic actuating device, as a result of which it can slide axially.

DE 10 2005 048 732 A1 relates to an electromagnetic actuating unit of a hydraulic directional control valve. The electromagnetic actuating unit comprises an armature, which is arranged within an armature chamber such that it can slide axially, and a pole core, which is arranged in a receptacle in the housing by means of a press fit and delimits the armature chamber in one movement direction of the armature. An armature guide sleeve is provided for axially guiding the armature. Furthermore, the electromagnetic actuating unit comprises a coil which is preferably encapsulated with a non-magnetizable material so as to form a coil former. The armature is mounted in a sliding sleeve, as a result of which it can slide axially with low friction.

JP 2005-188630 A describes a hydraulic directional control valve having an electromagnetic actuating unit. The electromagnetic actuating unit comprises a coil for generating a magnetic field which acts on an armature which can slide axially. The armature comprises an actuating element which operates the hydraulic directional control valve. The actuating element is mounted in an axial bore in the housing of the electromagnetic actuating device, as a result of which it can slide axially.

FIG. 1 shows a longitudinal sectional illustration of a further electromagnetic actuating unit according to the prior art. Said electromagnetic actuating unit is designed for actuating a hydraulic directional control valve which is designed as a central valve and which is arranged radially within an internal rotor of an apparatus for variably adjusting the control times of an internal combustion engine. The electromagnetic actuating unit comprises firstly a coil 01 which is fed electrically via a plug contact 02. The coil 01 is arranged within a coil former 03 which is produced by encapsulation of the coil 01 with a plastic. The magnetic field that can be generated by means of the coil 01 is transmitted via a soft-iron circuit, which comprises a yoke 04, a yoke disk 06, a pole core 07 and a housing 08, to a magnet armature 09 which is mounted such that it can move axially. The magnetic field exerts a magnetic force on the magnet armature 09 via an air gap between the pole core 07 and the magnet armature 09. Said magnetic force is transmitted via a pressure pin 11 of the magnet armature 09 to a piston of the central valve (not shown). The electromagnetic actuating unit is fastened by means of a flange 12 of the housing 08 to the central valve or to a housing surrounding the central valve. The magnetic field which can be generated by means of the coil 01 does not act entirely in the sliding direction of the magnet armature 09 on account of an eccentricity of the magnet armature 09. Said eccentricity is caused firstly by a degree of play of the magnet armature 09 and of the pressure pin 11 in the bearing arrangement thereof. Secondly, the eccentricity is a result of a deviation of the coaxiality between an armature bearing 13 and a pole core bearing 14. Said deviation may be extremely large depending on the assembly concept and on the tolerances of the components of the electromagnetic actuating unit. On account of the eccentricity of the magnet armature 09, parts of the magnetic field which can be generated by means of the coil 01 act laterally on the magnet armature 09, as a result of which forces are generated which act laterally on the magnet armature 09. Said laterally acting forces are proportional to the eccentricity of the magnet armature 09 or even proportional to the square of the eccentricity of the magnet armature 09. The alignment errors resulting from the deviation of the coaxiality between the armature bearing 13 and the pole core bearing 14 lead to tilting of the magnet armature 09 in its armature bearing 13. As a result of said tilting, the pressure pin 11 no longer slides on the entire bearing surface of the pole core bearing 14; in particular, a situation may arise in which the pressure pin 11 is mounted only on the edges of the pole core bearing 14. This leads to restricted functionality of the electromagnetic actuating unit and to increased wear of the pressure pin 11 and of the pole core bearing 14. Furthermore, the increased wear leads to an increasing eccentricity of the magnet armature 09, as a result of which the forces acting laterally on the magnet armature 09 increase yet further. As a result, the wear exhibits a progressive profile. The final result is failure of the apparatus for variably adjusting the control times of the internal combustion engine, in particular on account of the fact that the adjustment of the control times of the internal combustion engine can no longer take place within the admissible adjustment times.

New injection molding dies are always required for producing the known proportional magnets when variations in the magnet characteristics or stroke are desired or when other properties are intended to be changed in accordance with clients' requests.

SUMMARY OF THE INVENTION

It is the object of the present invention, taking the electromagnetic actuating unit and proportional magnet shown in FIG. 1 as a starting point, to provide an improved proportional magnet which can be produced in a particularly cost-effective manner and is robust during assembly and use, the intention being for simple adaptation to different requirements in respect of magnetic force characteristics, strokes and force levels being possible during production.

The proportional magnet according to the invention serves for the adjustment of a hydraulic directional control valve, for example for variably adjusting the control times of an internal combustion engine.

The proportional magnet initially comprises, as is known, a coil by means of which a magnetic field can be generated, and also an armature unit having an armature and a pressure pin. The pressure pin forms an actuator of the proportional magnet. By means of the pressure pin, the hydraulic directional control valve can be acted on so as to be adjusted. For this purpose, the armature unit is mounted at two bearing points such that it can slide along its axis. Said axis is usually formed by an axis of symmetry of the armature unit, which in a typical ideal design of electromagnetic actuating units is identical to the axis of symmetry of the armature and/or the coil. In order to slide the pressure pin axially, the armature acts on the pressure pin, which predefines the axial sliding movement. The armature and the pressure pin perform the axial sliding movement jointly. A soft-iron circuit with a yoke and a pole core conduct the magnetic flux of the coil. The armature is situated in the magnetic field of the coil between the yoke and the pole core, as a result of which said armature is acted on by a magnetic force which causes the sliding movement. The pressure pin follows the axial sliding movement of the armature.

According to the invention, the components of the proportional magnet are divided into two or three operative units which can be produced independently of one another, specifically a coil unit and a bearing unit and also a preferably integrally formed pole disk which functions as a cover of the coil unit. During assembly of the proportional magnet, the bearing unit is simply inserted into the coil unit and axially fixed by the pole disk. The advantageous result is a short tolerance chain in respect of the required coaxiality of the armature unit with the bearing points.

In addition, the bearing unit which can be produced separately allows a high degree of flexibility in respect of the production of different proportional magnets because only components of the hearing unit have to be changed and the coil unit can be used for all variants.

The coil unit is substantially pot-like and comprises an annular yoke disk, a coil and a magnet casing which surrounds the coil. The coil unit also has an encapsulation as a housing. The parts of the soft-iron circuit in the coil assembly, that is to say the yoke disk and the magnet casing, are preferably realized with simple punched parts, as a result of which production becomes particularly cost-effective. The encapsulation has the advantage that complex layering of the individual components and the complicated production of press fits between the punched parts of the iron circuit are dispensed with. A flange geometry can be directly extruded on during the encapsulation.

In another variant, the housing can also be produced in the form of an injection-molded part and the components are inserted and fixed in said injection-molded part for assembly purposes.

The coil unit has a cylindrical opening into which the bearing assembly can be easily inserted. The same coil unit can advantageously be used for the production of different proportional magnets. In addition, the hysteresis properties of the bearing unit can be checked before final assembly of the proportional magnet.

The hearing unit comprises a yoke with a first bearing point, a pole core with a second bearing point, and an armature which is arranged between said yoke and pole core and has an armature and a pressure pin. The armature unit is mounted in the two bearing points such that it can slide axially. The bearing points are coaxially oriented preferably by the assembled bearing unit being inserted into a centering sleeve.

The oil chamber is advantageously sealed off by the insertion of the hearing unit into the coil unit by means of the centering sleeve. As a result, a separately required seal can be dispensed with. The centering sleeve is preferably adhesively bonded or welded to the coil unit. A press fit of the centering sleeve in the coil unit is likewise possible.

Further possible refinements of the invention are specified in the dependent claims.

BRIEF DESCRIPTION OF THE DRAWINGS

A preferred embodiment of the invention will be explained in greater detail below with reference to the figures, in which.

DETAILED DESCRIPTION OF THE INVENTION

Figure 1:
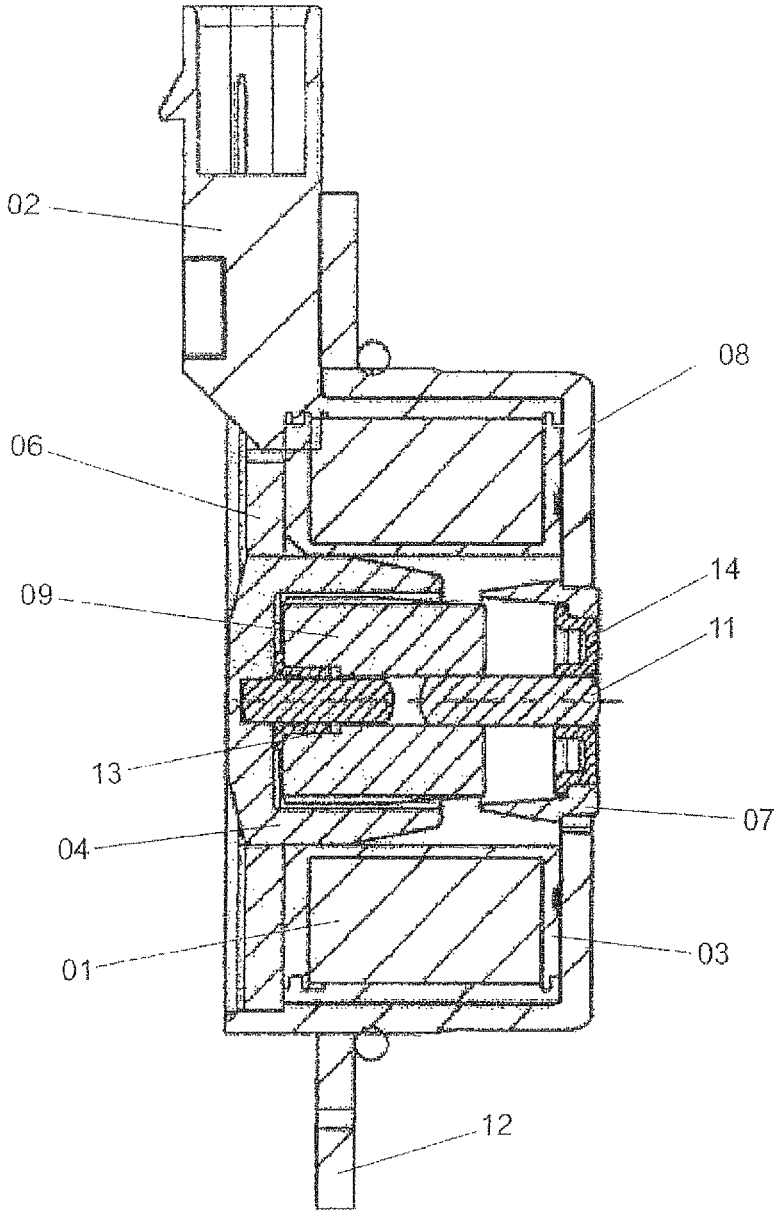
Fig. 1 Prior art
FIG. 1 shows a longitudinal sectional illustration through a proportional magnet according to the prior art.

FIG. 1 shows an electromagnetic actuating unit (proportional magnet) for a hydraulic directional control valve for variably adjusting the control times of an internal combustion engine as is known from the prior art and has already been explained in the introductory part of the description.

FIGS. 2*a* and 2*b* show a proportional magnet according to the invention having a coil unit 16, a bearing unit 17 and a pole disk 18. FIG. 2*a* shows an exploded illustration, while FIG. 2*b* shows a longitudinal sectional illustration. The proportional magnet has, in principle, the same design and manner of operation as the embodiment, as described in FIG. 1, according to the prior art. Therefore, the same reference numerals are used for the same components.

The proportional magnet comprises a coil 01, a plug contact 02, a coil former 03, a yoke 04, a yoke disk 06, a pole core 07, a magnet housing for conducting the magnetic flux, a magnet armature 09 and a pressure pin 11. The functional relationship between the stated components is the same as the functional relationship between the components of the electromagnetic actuating unit according to the prior art which is shown in FIG. 1.

The magnet armature 09 and pressure pin 11 form an armature unit. The magnet armature 09 has a central bore 19 through which the pressure pin 11 is routed. The pressure pin 11 is mounted in a first bearing point 21, which is located in the yoke 04, and in a second bearing point 22, which is provided in the pole core 07. In modifications, the armature unit can also be integrally formed or be designed as illustrated in FIG. 1. The bearing points 21, 22 are preferably designed as sliding bearings. The components are centered during assembly by a centering sleeve 24 which is produced from a non-magnetizable material.

The magnet housing is formed by the pole disk 18 and a magnet casing 23.

The proportional magnet is assembled by the bearing unit 17 being inserted into a cylindrical opening 26 in the coil unit 16. The bearing unit 17 can be adhesively bonded or welded or have a press fit in the opening 26. This advantageously forms a seal relative to the oil chamber. The pole disk 18 is then fitted, lugs 27 of the pole disk 18 and tugs 28 of the coil unit 16 coming to rest against one another in a rotationally fixed manner in the process. The magnet circuit is also closed by means of the pole core 07, pole disk 18, magnet casing 23, yoke disk 06 and yoke 04 in the process. Fixing can be performed by adhesive bonding, welding, soldering or press-fitting.

Figure 3:
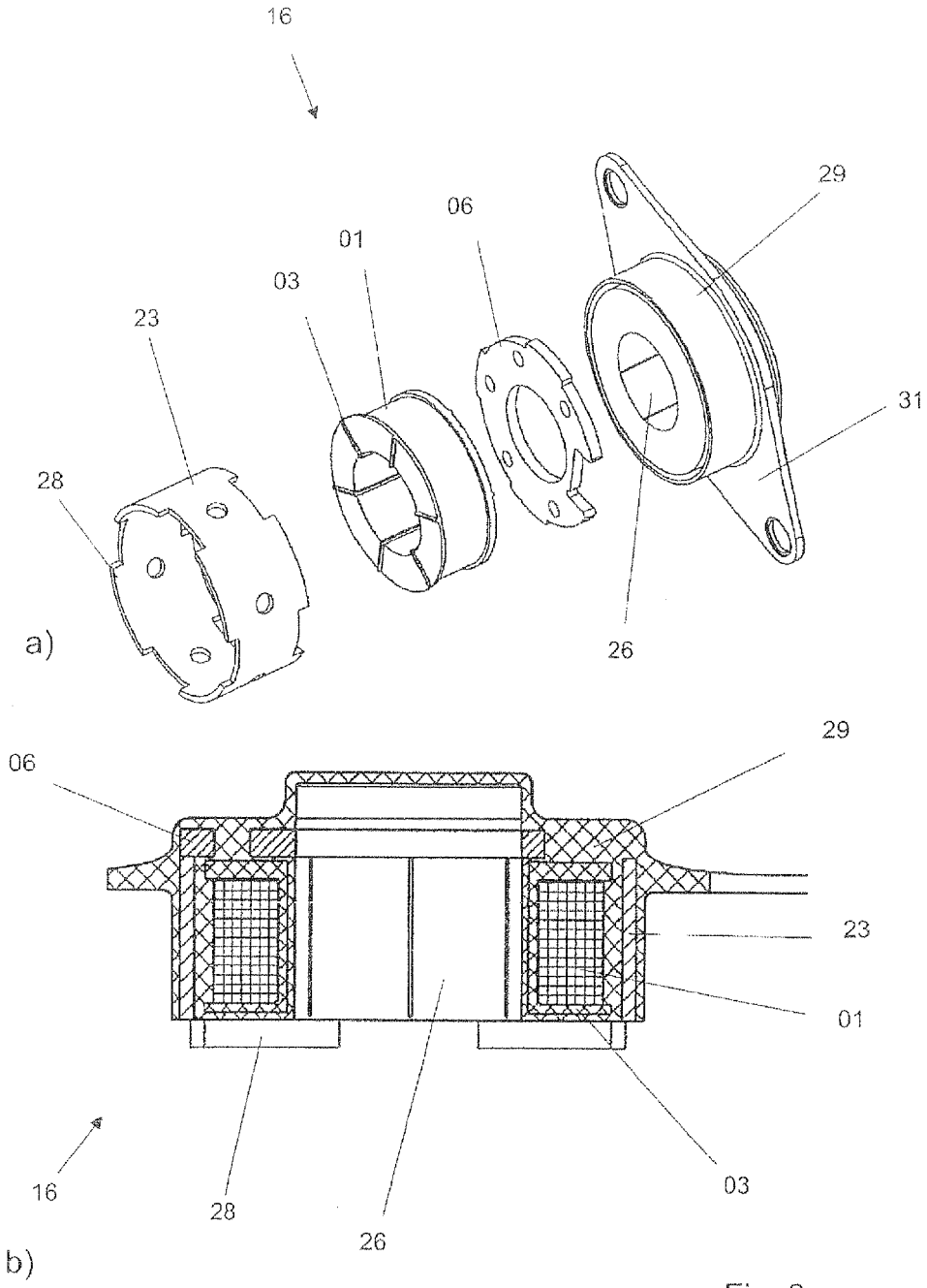
FIG. 3*a* shows an exploded illustration of a coil unit of the proportional magnet which is illustrated in FIGS. 2*a* and 2*b;*
FIG. 3*b* shows a sectional view of a coil unit of the proportional magnet which is illustrated in FIGS. 2*a* and 2*b:*

FIG. 3*a* shows the coil unit 16 in an exploded illustration and FIG. 3*b* shows the coil unit 16 in a longitudinal sectional illustration. The coil 01 is wound onto the coil former 03. The cylindrical magnet casing 23 is pushed over the coil 01 and the yoke disk 06 covers one of the base areas of the magnet casing 23 in an annular section after the assembly. The coil unit 16 is then encapsulated, and therefore a housing encapsulation 29 is formed. The housing encapsulation 29 also has a fastening flange 31. The bearing unit 17 can be inserted into the opening 26.

Figure 4:
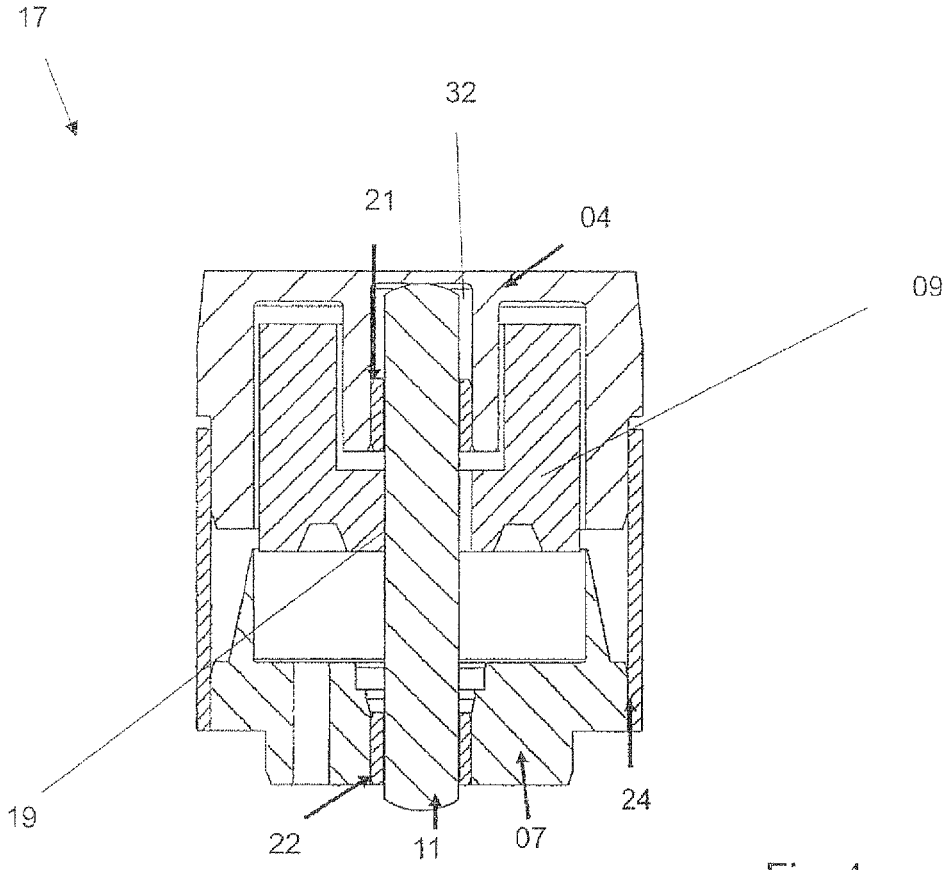
FIG. 4 shows a sectional view of a bearing unit of the proportional magnet which is illustrated in FIGS. 2*a* and 2*b;*

FIG. 4 shows a longitudinal sectional illustration through the bearing unit 17. The first bearing point 21 is designed as a sliding bearing in a yoke bush 32 which is formed in the yoke 04 and in which the pressure pin 11 is mounted at one end. The pressure pin 11 is mounted in the second bearing point 22, which is provided in the pole core 07, by way of its other end. The centering sleeve 24 coaxially orients the bearing points 21, 22 with the pressure pin 11 during assembly of the bearing unit 17. The magnet armature 09 has the central bore 19 through which the pressure pin 11 is routed.

Figure 5:
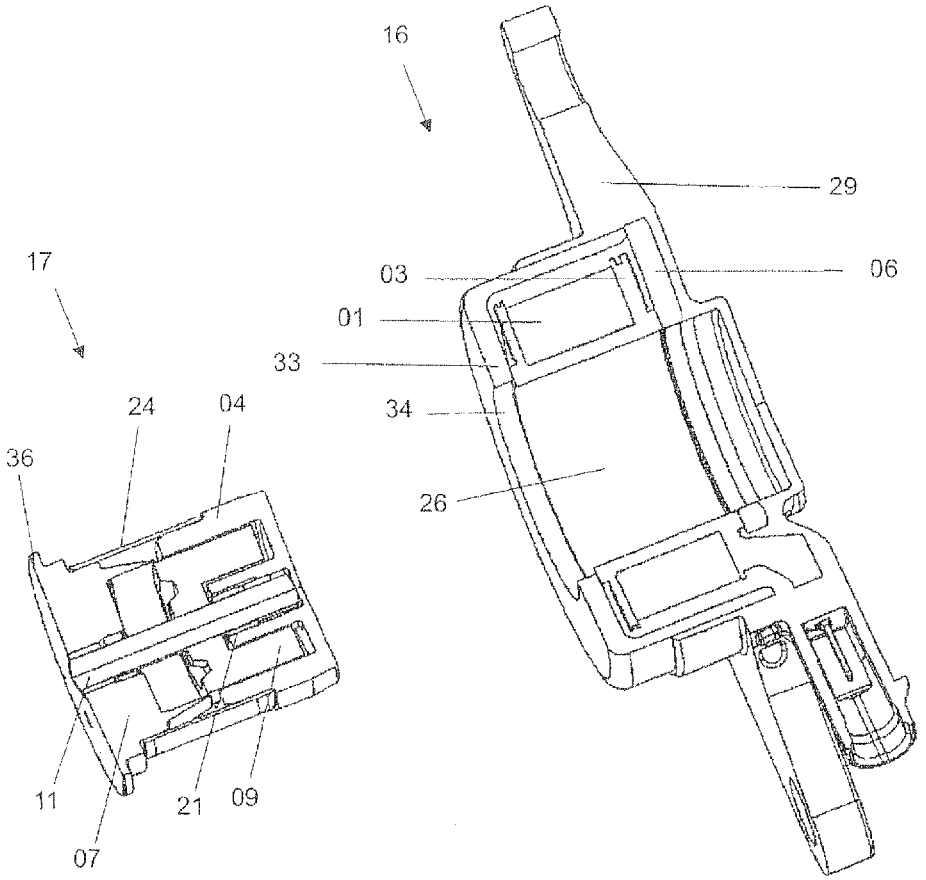
FIG. 5*a* shows an exploded illustration.
FIG. 5*b* shows a sectional view of a further embodiment of a proportional magnet according to the invention.
Figure 5:
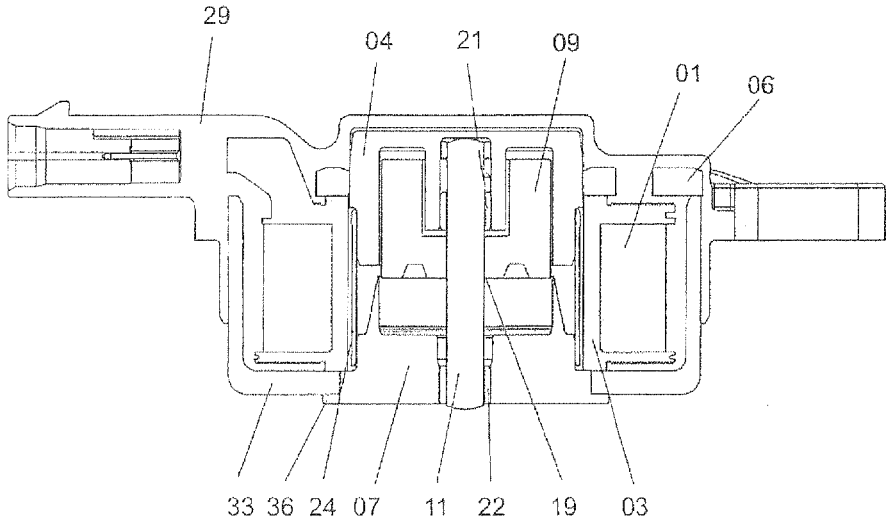

FIGS. 5*a* and 5*b* show a further proportional magnet according to the invention having a coil unit 16 and a bearing unit 17. FIG. 5*a* shows an exploded illustration, while FIG. 5*b* is a longitudinal sectional illustration. The proportional magnet has, in principle, the same design and manner of operation as the embodiment which is described in FIG. 1. Therefore, the same reference numerals are used for the same components.

Figure 2:
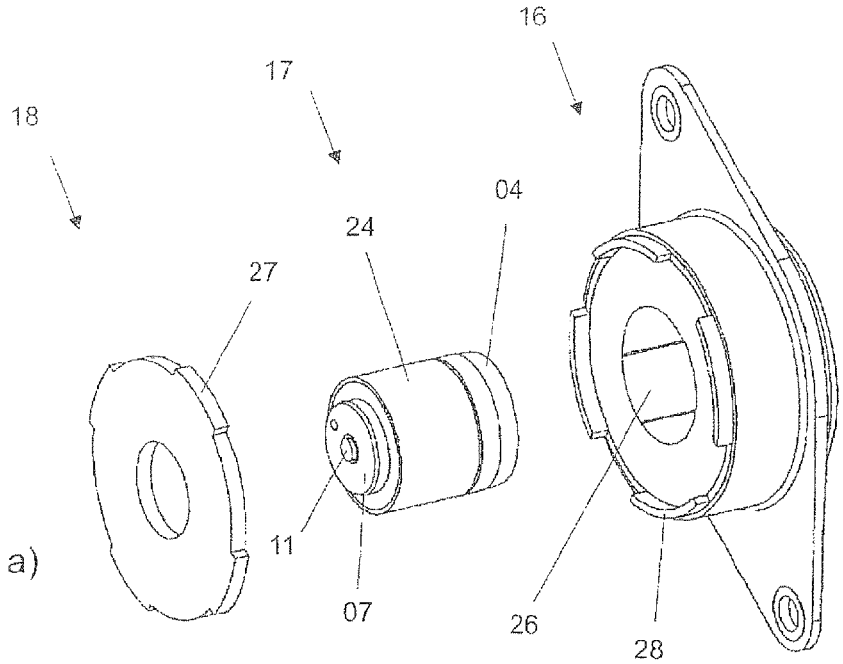
FIG. 2*a* shows an exploded illustration.
FIG. 2*b* shows a sectional view of a proportional magnet according to the invention.
Figure 2:
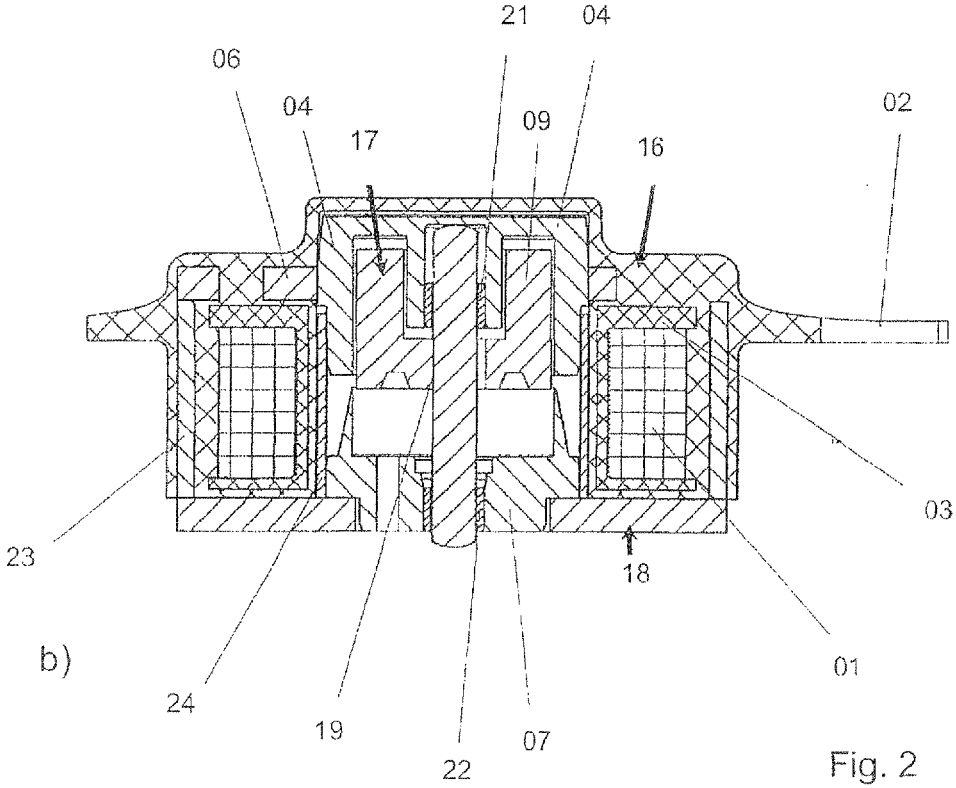

The proportional magnet comprises the coil 01, the plug contact 02, the coil former 03, the yoke 04, the yoke disk 06, the pole core 07, the magnet housing for conducting the magnetic flux, the magnet armature 09 and a pressure pin 11. The functional relationship between the stated components is the same as the functional relationship between the components of the electromagnetic actuating unit according to the prior art which is shown in FIG. 2.

The magnet armature 09 and the pressure pin 11 form an armature unit. The magnet armature 09 has a central bore 19 through which the pressure pin 11 is routed. The pressure pin 11 is mounted in the first bearing point 21, which is located in the yoke 04, and in the second bearing point 22, which is provided in the pole core 07. In modifications, the armature unit can also be integrally formed or be designed as illustrated in FIG. 1. The bearing points 21, 22 are preferably designed as sliding bearings. The components are centered during assembly by a centering sleeve 24 which is produced from a non-magnetizable material. The centering sleeve 24 can be adhesively bonded or welded to the yoke 04 and to the pole core 07.

A significant difference from the embodiment which is illustrated in FIGS. 2*a* and 2*b* is that the magnet housing, which is formed from the magnet casing and the pole disk in the embodiment which is shown in FIGS. 2*a* and 2*b*, is completely integrated in the coil unit. In the case which is shown in FIGS. 5*a* and 5*b*, the magnet housing is formed from a pot-like magnet casing 33 which is open at the top. The magnet casing 33 has, in its base, an opening 34 which is the same size as the opening 26. This design has the advantage that the proportional magnet is composed only of two functional assemblies, this saving an assembly step.

The bearing unit is changed in such a way that the pole core 07 has a border 36 which is located at the end face of the bearing unit and extends in the radial direction, as a result of which the opening 34 in the magnet casing 33 of the coil unit 16 is completely closed during assembly of the proportional magnet.

The proportional magnet is assembled by the bearing unit 17 being inserted into the cylindrical opening 26. The bearing unit 17 can be adhesively bonded or welded in the opening 26 in the coil unit 16 or have a press fit between the yoke disk 06 and the yoke 04. This advantageously forms a seal relative to the oil chamber. The opening 34 in the magnet casing 33 is completely closed by the border 36 at the end face of the pole core 07. The magnet circuit is also closed by means of the pole core 07, magnet casing 23, yoke disk 06 and yoke 04 in the process. The axial fixing means between the magnet casing 33 and the pole core 07 can be additionally protected by adhesive bonding, welding, soldering or caulking. A radial gap between the pole core 07 and the magnet casing 33 is necessary in order to avoid lateral forces which could result from coaxiality defects in the individual components.

LIST OF REFERENCE NUMERALS

01 Coil
02 Plug Contact
03 Coil Former
04 Yoke
05 -
06 Yoke Disk
07 Pole Core
08 Housing
09 Magnet Armature
10 -
11 Pressure Pin
12 Flange
13 Armature Bearing
14 Pole core Bearing

15 -
16 Coil Unit
17 Bearing Unit
18 Pole Disk
19 Central Bore
20 -
21 Bearing Point, First.
22 Bearing Point, Second
23 Magnet Casing
24 Centering Sleeve
25 -
26 Opening
27 Lug
28 Lug
29 Housing Encapsulation
30 -
31 Fastening Flange
32 Yoke Bush
33 Magnet Casing
34 Opening
35 -
36 Border

The invention claimed is:

1. A proportional magnet for a hydraulic directional control valve, comprising:

a coil unit having a cylindrical coil with a cylindrical opening, a cylindrical magnet casing which surrounds the coil, an annular yoke disk arranged at an end face of the magnet casing, and a housing;

a bearing unit including a yoke with a first hearing point, a pole core with a second bearing point, an armature unit having a magnet armature and a pressure pin, a centering sleeve coaxially orientating the first bearing point, the second bearing point and the armature unit, the centering sleeve being a separate element from the yoke and the pole core, the bearing unit being inserted into the cylindrical opening in the coil unit; and an annular pole disk fitted on the coil unit as a cover.

2. The proportional magnet as claimed in claim 1, wherein the yoke disk, the magnet casing and the pole disk are parts punched out of soft-iron material.

3. The proportional magnet as claimed in claim 1, wherein the centering sleeve is adhesively bonded or welded to the coil unit.

4. A proportional magnet for a hydraulic directional control valve, comprising:

a coil unit including a cylindrical coil with a cylindrical opening, a pot-like open magnet casing that surrounds the coil and has a base with an opening and an open end face, an annular yoke disk arranged at the open end face of the magnet casing, and a housing; and a bearing unit including a yoke with a first bearing point, a pole core with a second bearing point, an armature unit with a magnet armature and a pressure pin, a centering sleeve coaxially orientating the first bearing point, the second bearing point and the armature unit, the centering sleeve being a separate element from the yoke and the pole core, the bearing unit being inserted into the cylindrical opening in the coil unit.

5. The proportional magnet as claimed in claim 4, wherein the centering sleeve is adhesively bonded or welded to the pole core and the yoke.

6. The proportional magnet as claimed in claim 4, wherein the pole core is adhesively bonded, welded or caulked to the magnet casing of the coil unit.

7. The proportional magnet as claimed in claim 1, wherein the housing is a housing encapsulation.

8. The proportional magnet as claimed in claim 4, wherein the coil unit has a housing and the housing is a housing encapsulation.

9. The proportional magnet as claimed in claim 1, wherein the bearing unit is adhesively bonded, welded or fixed by a press fit in the cylindrical opening in the coil unit.

10. The proportional magnet as claimed in claim 4, wherein the bearing unit is adhesively bonded, welded or fixed by a press fit in the cylindrical opening in the coil unit.

11. A method for producing a proportional magnet, comprising the following steps:

manufacturing a coil unit from a housing part, a yoke disk, an electrical coil and a magnet casing;

manufacturing a bearing unit from an armature unit having a magnet armature and a pressure pin, a yoke, a pole core, and a centering sleeve, with the armature unit being mounted in a first bearing point in the yoke and in a second bearing point in the pole core, and the yoke and pole core being separately arranged on the centering sleeve so that the centering sleeve coaxially orientates the first bearing point, the second bearing point and the armature unit;

assembling the proportional magnet by inserting and axially fixing the bearing unit into a cylindrical opening in the coil unit and fixing a pole disk on the coil unit by press-fitting, adhesive bonding, welding or soldering so that a magnetic circuit is closed by means of the pole core, the pole disk, the magnet casing, the yoke disk and the yoke, and the bearing unit is axially fixed in the coil unit.

* * * * *